US010900656B1

(12) United States Patent
Wang

(10) Patent No.: US 10,900,656 B1
(45) Date of Patent: Jan. 26, 2021

(54) WATERPROOF STRUCTURE LAMP HOLDER

(71) Applicant: Jianguo Wang, Dongguan (CN)

(72) Inventor: Jianguo Wang, Dongguan (CN)

( * ) Notice: Subject to any disclaimer, the term of this patent is extended or adjusted under 35 U.S.C. 154(b) by 0 days.

(21) Appl. No.: 17/082,031

(22) Filed: Oct. 28, 2020

(51) Int. Cl.

| | |
|---|---|
| ***F21S 4/00*** | (2016.01) |
| ***F21V 31/00*** | (2006.01) |
| ***F21V 23/06*** | (2006.01) |
| ***F21S 4/10*** | (2016.01) |
| *F21Y 103/10* | (2016.01) |
| *F21Y 115/10* | (2016.01) |

(52) U.S. Cl.
CPC ..... *F21V 31/005* (2013.01); *F21S 4/10* (2016.01); *F21V 23/06* (2013.01); *F21Y 2103/10* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 7,121,712 | B1 * | 10/2006 | Lin | F21V 19/0005 362/654 |
| 8,172,427 | B2 * | 5/2012 | Hsu | F21V 19/0005 362/249.16 |
| 10,401,011 | B2 * | 9/2019 | Han | F21S 4/10 |
| 2006/0146578 | A1 * | 7/2006 | Kuo | F21S 4/10 362/654 |
| 2012/0025694 | A1 * | 2/2012 | Bing | F21V 19/0005 313/318.01 |
| 2015/0211727 | A1 * | 7/2015 | Loomis | F21V 31/005 362/311.02 |

* cited by examiner

*Primary Examiner* — Elmito Breval

(57) ABSTRACT

The present disclosure relates to the field of light decorations and lamps, and in particular, to a waterproof structure lamp holder. The waterproof structure lamp holder of the present disclosure has a simple and reasonable structure design. A waterproof ring is disposed at a lower end of a lamp head holder at a position that is close to a lower end of a thread-connected portion of a light housing. In addition, a waterproof plug is disposed at an upper end of a spiral portion inside the lamp head holder. This double waterproof design ensures desirable waterproof performance thereof, prevents electric shock, and is safer. In addition, the lamp head holder integrally formed through injection molding has better waterproof performance, and facilitates automatic production and assembly.

8 Claims, 2 Drawing Sheets

WATERPROOF STRUCTURE LAMP HOLDER

TECHNICAL FIELD

The present disclosure relates to the field of light decorations and lamps, and in particular, to a waterproof structure lamp holder.

BACKGROUND

Lamp strings are widely used in the field of decorative lighting, and are usually hung on a wall or a modeling object to create an atmosphere. Light emitted by a light string can play a good decorative and setting off role.

A traditional common lamp string includes multiple bulbs connected in series. A tungsten filament lamp string is characterized by a soft and warm light ray. An LED light string subsequently, appears, and has a structure mainly including one light line and multiple lamps connected below the light line. Because the LED light string is usually hung outdoors, connection strength of each component and convenience of disassembly and installation are very important. At present, an LED lamp board is usually used as a lamp light source. A lamp structure includes: a lamp head holder, an LED light board, a light guide column and a lamp cover. The lamp cover is connected to the lamp head holder, and the lamp head holder with a specific structure is configured to install the LED light board and the light guide column. An existing lamp has the shortcomings of unreasonable design, poor waterproof performance, and proneness to damage, and therefore the service life is affected.

SUMMARY

To resolve the foregoing problem, the present disclosure provides a waterproof structure lamp holder, which has a simple and reasonable structure design, better waterproof performance, and is not prone to electric leakage or damage due to water inflow.

To achieve the foregoing objective, the present disclosure adopts the following technical solution: A waterproof structure lamp holder includes: a lamp head holder, a light housing, and a light emitting source. A connecting portion that extends downwards is disposed in the middle of the lamp head holder, and bumps are disposed on a surface of the connecting portion. A groove is disposed at an upper end of the light emitting source, and clamping holes corresponding to the bumps are disposed on two sides of the groove. A lower end of the connecting portion is plugged into the groove of the light emitting source, and the bumps are clamped into the clamping holes, A thread-connected portion is disposed on the periphery of an upper end of the light housing, a spiral portion is disposed on a side wall inside the lamp head holder, and the light housing is threadably fastened to the lamp head holder through the thread-connected portion and the spiral portion. A waterproof ring is disposed at a lower end of the lamp head holder at a position that is close to a lower end of the thread-connected portion of the light housing, and the waterproof ring is in contact with a surface of the fight housing. A waterproof plug is disposed at an upper end of the spiral portion inside the lamp head holder, and when the light housing is threadably fastened to the lamp head holder, the waterproof plug is in contact with a top end of the thread-connected portion.

Further, a metal contact is disposed on the connecting portion, a metal pin is disposed in the groove, and the connecting portion is electrically connected to the light emitting source through the metal contact and the metal pin.

The light emitting source is an LED light bar which includes a housing and an LED filament, wherein the LED filament is disposed in the housing, the groove is formed at an upper end of the housing, and the metal pin is electrically connected to the LED filament.

The housing is a glass housing or an adhesive housing.

Further, a vertical cylindrical opening extends from an opening at the upper end of the light housing, and the thread-connected portion is disposed on a surface at a lower end of the cylindrical opening.

Further, a hanging hole is further disposed at an upper end of the lamp head holder.

Further, the lamp head holder is integrally formed through injection molding.

In addition, lamp head holders are connected in parallel or in series through wires, to form a light emitting lamp string.

The present disclosure has the following beneficial effects: The waterproof structure lamp holder of the present disclosure has a simple and reasonable structure design. The light emitting source is directly plugged and fastened onto the lamp head holder and is clamped through the bumps, to ensure that the light emitting source is not easy to fall off. The light housing is threadably fasted to the lamp head holder through the thread-connected portion and the spiral portion. The waterproof ring is disposed at the lower end of the lamp head holder at the position that is close to the lower end of the thread-connected portion of the light housing, and the waterproof ring is in contact with the surface of the light housing, to achieve primary waterproofing. In addition, the waterproof plug is disposed at the upper end of the spiral portion inside the lamp head holder, and when the light housing is threadably fastened to the lamp head holder, the waterproof plug is in contact with the top end of the thread-connected portion, to achieve secondary waterproofing. This double waterproof design ensures desirable waterproof performance thereof, and a human body will not come into contact with metal in the lamp head holder, which prevents electric shock and is safer. In addition, the lamp head holder integrally formed through injection molding has better waterproof performance, and facilitates automatic production and assembly.

DESCRIPTIONS OF REFERENCE NUMERALS

1. Lamp head holder; 11. Connecting portion; 111. Bump; 12. Spiral portion; 13. Waterproof ring; 14. Waterproof plug; 15. Hanging hole; 2. Light housing; 21. Thread-connected portion; 3. Light emitting source; 31. Housing; 311. Groove; 312. Clamping hole; 32. LED filament; 33. Metal pin; and 4. Wire.

DETAILED DESCRIPTION

The present disclosure is further described below in detail in specific implementations with reference to the accompanying drawings. This application can be implemented in various different forms, and is not limited to the implementations described in the embodiments. The following specific implementations are provided to facilitate clearer and more thorough understanding of contents disclosed in the application. Terms indicating orientations such as front, rear, left, and right are only intended to indicate a position of a structure shown in a corresponding accompanying drawing.

Figure 1:
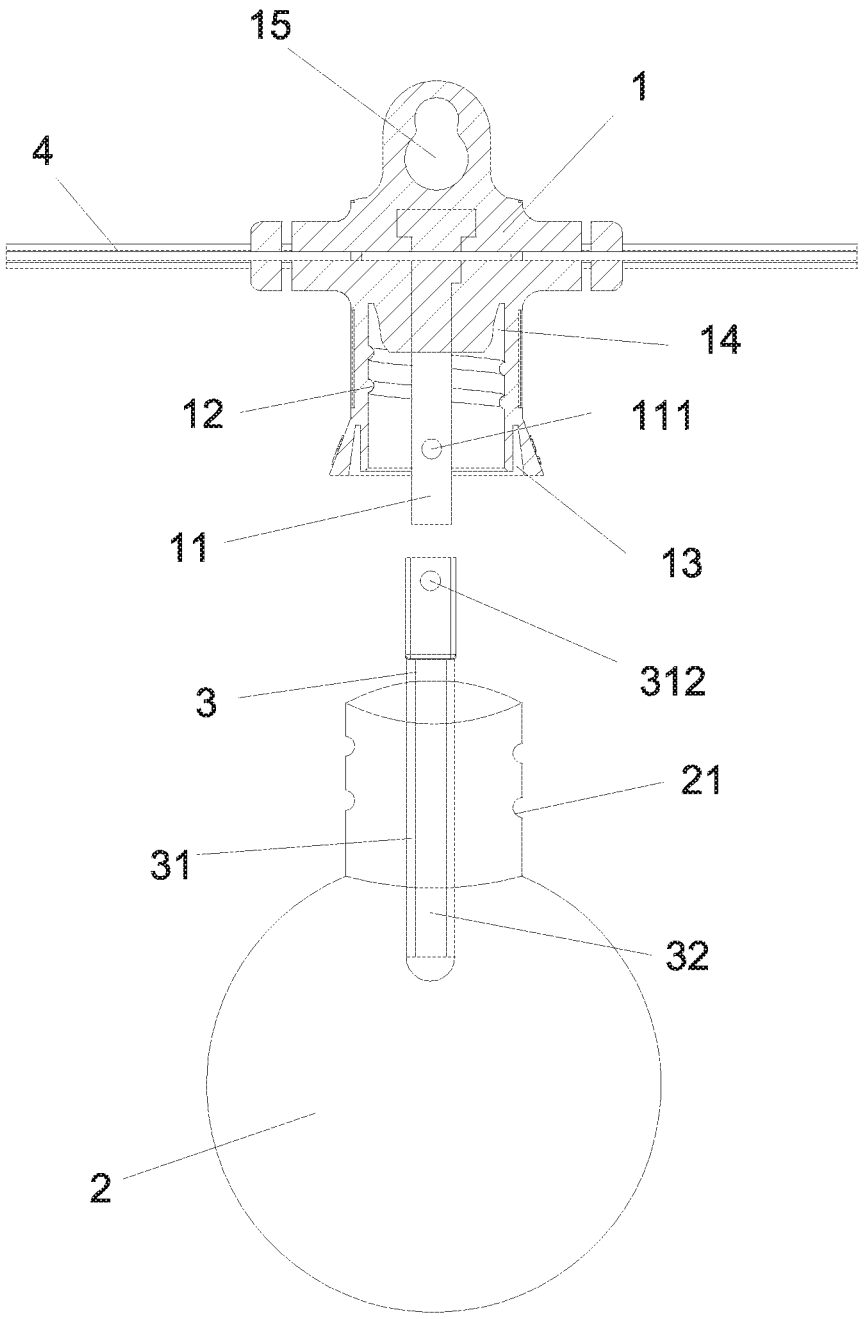
FIG. 1 is a schematic structural diagram according to an embodiment.
Figure 2:
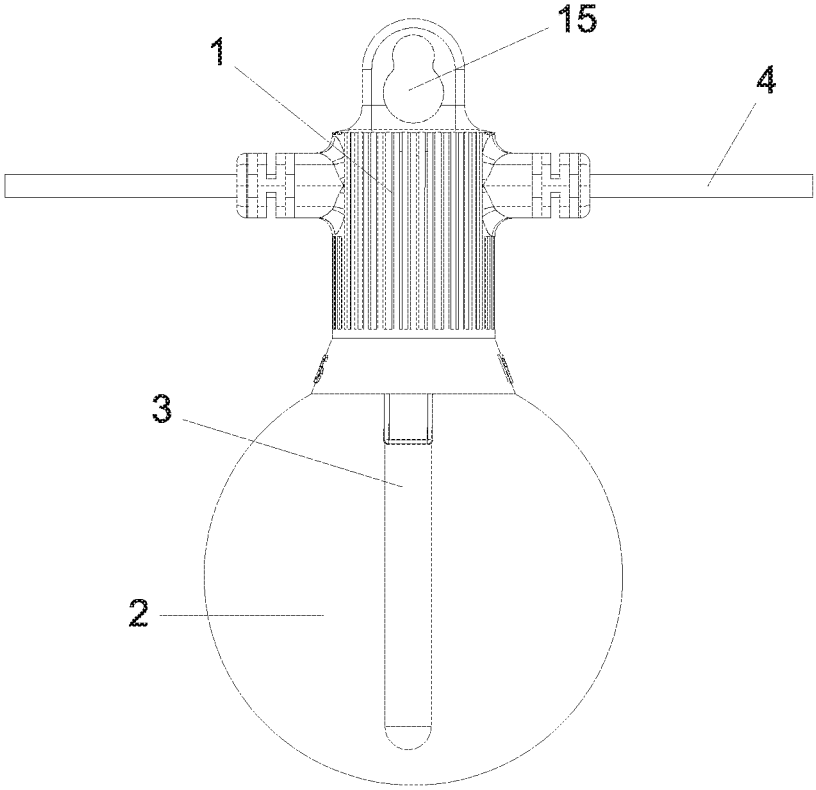
FIG. 2 is a sectional view showing an internal structure according to an embodiment.
Figure 3:
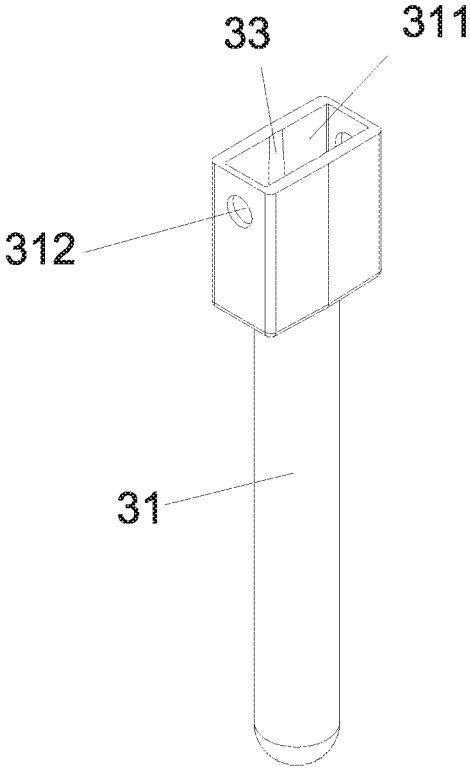
FIG. 3 is a schematic structural diagram of a light emitting source according to an embodiment.

Referring to FIG. 1 to FIG. 3, the present disclosure relates to a waterproof structure lamp holder; including: a lamp head holder 1, a light housing 2, and a light emitting source 3. A connecting portion 11 that extends downwards is disposed in the middle of the lamp head holder 1; and bumps 111 are disposed on a surface of the connecting portion 11. A groove 311 is disposed at an upper end of the light emitting source 3, and clamping holes 312 corresponding to the bumps 111 are disposed on two sides of the groove 311. A lower end of the connecting portion 11 is plugged into the groove 311 of the light emitting source 3, and the humps 111 are clamped into the clamping holes 312. A thread-connected portion 21 is disposed on the periphery of an upper end of the light housing 2, a spiral portion 12 is disposed on a side wall inside the lamp head holder 1, and the light housing 2 is threadably fastened to the lamp head holder 1 through the thread-connected portion 21 and the spiral portion 12. A waterproof ring 13 is disposed at a lower end of the lamp head holder 1 at a position that is close to a lower end of the thread-connected portion 21 of the light housing 2, and the waterproof ring 13 is in contact with a surface of the light housing 2, A waterproof plug 14 is disposed at an upper end of the spiral portion 12 inside the lamp head holder 1, and when the light housing 2 is threadably fastened to the lamp head holder 1, the waterproof plug 14 is in contact with a top end of the thread-connected portion 21.

Compared with the prior art, the waterproof ring 13 is disposed at the lower end of the lamp head holder 1 at the position that is close to the lower end of the thread-connected portion 21 of the light housing 2, and the waterproof ring 13 is in contact with the surface of the light housing 2, to achieve primary waterproofing. The waterproof plug 14 is disposed at the upper end of the spiral portion 12 inside the lamp head holder 1, and when the light housing 2 is threadably fastened to the lamp head holder 1, the waterproof plug 14 is in contact with the top end of the thread-connected portion 21, to achieve secondary waterproofing. This double waterproof design ensures desirable waterproof performance thereof.

In the embodiments, the light emitting source 3 is an LED light bar which includes a housing 31 and an LED filament 32. The LED filament 32 is disposed in the housing 31, the groove 311 is formed at an upper end of the housing 31, and a metal pin 33 is electrically connected to the LED filament 32. The LED light bar is used as the light emitting source 3 which does not require a drive power supply, and can be used normally when either an alternating current or a direct current is used. The housing 31 is a glass housing or an adhesive housing, to ensure that a light source emitted by the LED filament 32 transmits through the housing 31.

In addition, a metal contact is disposed on a surface of the connecting portion 11, the metal pin 33 is disposed in the groove 311, and the connecting portion 11 is electrically connected to the light emitting source 3 through the metal contact and the metal pin 33, to ensure that when the light emitting source 3 is plugged into the lamp head holder 1, an electrical connection is implemented to enable power-on.

In the embodiments, a vertical cylindrical opening extends from an opening at the upper end of the light housing 2, and the thread-connected portion 21 is disposed on a surface at a lower end of the cylindrical opening. A hanging hole 15 is further disposed at an upper end of the lamp head holder 1, to help hang and fasten a lamp.

In the embodiments, the lamp head holder 1 is integrally formed through injection molding and reaches a waterproof level of IP64, so that the lamp head holder 1 not only has desirable waterproof performance, but also facilitates assembly. The LED light bar of the light emitting source 3 in the embodiments may be used in a 3-260V AC or DC voltage. In addition, lamp head holders 1 may be connected in parallel or in series through wires 4, to form a light emitting lamp string, which has desirable waterproof performance, is not prone to damage, and facilitates replacement and disassembly.

It should be further noted that, unless otherwise specified and limited clearly, terms such as "connect", "fasten", and "dispose" shall be understood in a broad sense. A person with ordinary skill in the art can understand specific meanings of these terms in the present disclosure according to specific circumstances.

The foregoing implementations are only intended to describe the preferred implementations of the present disclosure, and do not limit the scope of the present disclosure. Various modifications and improvements of the technical solutions of the present disclosure made by a person with ordinary skill in the art without departing from the design spirit of the present disclosure shall fall within the protection scope defined by the claims of the present disclosure.

The invention claimed is:

1. A waterproof structure lamp holder, comprising: a lamp head holder, a light housing, and a light emitting source, wherein a connecting portion that extends downwards is disposed in the middle of the lamp head holder, bumps are disposed on a surface of the connecting portion, a groove is disposed at an upper end of the light emitting source, clamping holes corresponding to the bumps are disposed on two sides of the groove, a lower end of the connecting portion is plugged into the groove of the light emitting source, the bumps are clamped into the clamping holes, a thread-connected portion is disposed on the periphery of an upper end of the light housing, a spiral portion is disposed on a side wall inside the lamp head holder, the light housing is threadably fastened to the lamp head holder through the thread-connected portion and the spiral portion, a waterproof ring is disposed at a lower end of the lamp head holder at a position that is close to a lower end of the thread-connected portion of the light housing, the waterproof ring is in contact with a surface of the light housing, a waterproof plug is disposed at an upper end of the spiral portion inside the lamp head holder, and when the light housing is threadably fastened to the lamp head holder, the waterproof plug is in contact with a top end of the thread-connected portion.

2. The waterproof structure lamp holder according to claim 1, wherein a metal contact is disposed on the connecting portion, a metal pin is disposed in the groove, and the connecting portion is electrically connected to the light emitting source through the metal contact and the metal pin.

3. The waterproof structure lamp holder according to claim 2, wherein the light emitting source is an LED light bar, the LED light bar comprises a housing and an LED filament, the LED filament is disposed in the housing, the groove is formed at an upper end of the housing, and the metal pin is electrically connected to the LED filament.

4. The waterproof structure lamp holder according to claim 3, wherein the housing is a glass housing or an adhesive housing.

5. The waterproof structure lamp holder according to claim 1, wherein a vertical cylindrical opening extends from an opening at the upper end of the light housing, and the thread-connected portion is disposed on a surface at a lower end of the cylindrical opening.

6. The waterproof structure lamp holder according to claim 1, wherein a hanging hole is further disposed at an upper end of the lamp head holder.

7. The waterproof structure lamp holder according to claim 1, wherein the lamp head holder is integrally formed through injection molding.

8. The waterproof structure lamp holder according to claim 1, wherein lamp head holders are connected in parallel or in series through wires, to form a light emitting lamp string.

* * * * *